US005088267A

United States Patent [19]

Gee

[11] Patent Number: 5,088,267

[45] Date of Patent: Feb. 18, 1992

[54] APPARATUS AND METHODS FOR PLACING AN OBJECT INSIDE AN INFLATED BALLOON

[76] Inventor: Anthony L. Gee, 1207 N. 1650 West, Provo, Utah 84604

[21] Appl. No.: 398,781

[22] Filed: Aug. 25, 1989

[51] Int. Cl.[5] ..... B65B 31/00; B65B 31/02; B65B 43/36; B65B 67/02

[52] U.S. Cl. ..... 53/86; 53/556; 53/386.1; 53/390; 141/8; 141/10; 141/65; 141/114

[58] Field of Search ..... 53/403, 432, 434, 441, 53/453, 459, 469, 479, 481, 79, 86, 512, 556, 559, 570, 385, 386, 390, 416, 433, 511; 141/10, 51, 59; 206/459

[56] References Cited

U.S. PATENT DOCUMENTS

| | | | |
|---|---|---|---|
| 1,283,095 | 10/1918 | Cummiskey | 446/220 |
| 1,745,576 | 2/1930 | Kempien | 446/220 |
| 2,158,837 | 5/1939 | Schukraft | 53/411 |
| 2,364,012 | 11/1944 | Walton et al. | 53/434 X |
| 2,383,390 | 8/1945 | Jacobs | 446/220 X |
| 2,418,142 | 4/1947 | Socke | 53/386 |
| 2,463,517 | 3/1949 | Chromak | 446/220 X |
| 2,531,795 | 11/1950 | Walter | 53/397 |
| 2,783,786 | 3/1957 | Carter | 141/59 X |
| 2,815,621 | 12/1957 | Carter | 141/51 X |
| 2,831,510 | 4/1958 | Carter | 53/386 X |
| 2,836,941 | 6/1958 | Hultkrans et al. | 53/411 |
| 3,321,103 | 5/1967 | Phillips | 53/390 X |
| 3,350,838 | 11/1967 | Rodrigues | 53/86 |
| 3,798,870 | 3/1974 | Kanner et al. | 53/386 X |
| 4,060,107 | 11/1977 | Naftulin | 141/10 X |
| 4,251,976 | 2/1981 | Zanni | 53/433 |
| 4,480,536 | 11/1984 | Burns | 53/585 X |
| 4,516,949 | 5/1985 | Schwartz | 53/403 X |
| 4,546,881 | 10/1985 | Tasma | 206/459 |
| 4,704,934 | 11/1987 | Nosrati | 446/220 X |
| 4,753,060 | 6/1988 | Furukawa | 53/469 X |
| 4,809,483 | 3/1989 | Lovik | 53/385 X |
| 4,809,484 | 3/1989 | Lovik | 53/385 X |
| 4,811,841 | 3/1989 | Domenichiello | 206/423 |
| 4,878,335 | 11/1989 | Hardy | 53/385 X |
| 4,924,919 | 5/1990 | Oyler | 53/386 X |
| 4,974,393 | 12/1990 | Rich et al. | 53/433 |

*Primary Examiner*—Horace M. Culver
*Attorney, Agent, or Firm*—Berne S. Broadbent

[57] ABSTRACT

An apparatus for use in placing an object inside an inflated balloon is disclosed as comprising a housing forming a first chamber and a second chamber. The housing has a lid with an orifice therein which communicates with the first chamber, and a flexible diaphragm having a hole therethrough is positioned in the orifice. At least three rams are positioned on the lid of the housing so as to substantially surround the diaphragm, and a substantially L-shaped finger is attached to the actuating rod of each ram, the fingers lying adjacent one another when the actuating rods of the rams are in an unretracted position with each finger extending through the hole through the diaphragm. After the neck of a balloon is placed around the fingers, the actuating rods of the rams may be retracted, thereby enlarging the neck of the balloon and forming a substantially air-tight seal between the neck of the balloon and the flexible diaphragm. A vacuum pump having an air intake port and an air exhaust port is positioned such that the air intake port communicates with the first chamber, whereby the first chamber can be evacuated and the balloon inflated. The air exhaust port of the vacuum pump communicates with the second chamber, and a filling nipple is provided which communicates with the second chamber such that it can be connected to the neck of a balloom so as to inject air from said second chamber into the balloon.

9 Claims, 3 Drawing Sheets

APPARATUS AND METHODS FOR PLACING AN OBJECT INSIDE AN INFLATED BALLOON

BACKGROUND

1. The Field of the Invention

This invention relates to apparatus and methods for use in placing objects (such as, for example, stuffed animals, shirts, or flowers), inside an inflated balloon. More particularly, this invention relates to novel apparatus and methods for such purpose wherein the neck of the balloon is enlarged automatically so as to readily accommodate the placement of the object inside the balloon and/or wherein the balloon is inflated by means of exteriorly applied vacuum pressure prior to placement of the object therein.

2. The Background Art

In recent years, it has become popular to "gift wrap" various objects with an inflated balloon. A stuffed animal, flower arrangement, shirt, card, or other gift item may, for example, be placed inside of an inflated balloon before giving the gift to the desired recipient. At present, there seems to be an increasing demand for this type of "gift wrapping" service and for devices and methods to facilitate the service.

Various objects have, in the past, been placed inside of a balloon by simply stretching the neck of the balloon over the object and/or by otherwise forcing the object into the balloon. Thereafter, the balloon, with the object inside, can be inflated and tied in conventional fashion.

While the foregoing method is certainly straightforward, it is fraught with difficulties. It will, of course, be appreciated that it can be extremely awkward to stretch the neck of a balloon over some kinds of objects. Except in the case of small objects, the process is most often very time-consuming. Moreover, this method of placing an object inside a balloon will frequently damage the balloon, destroy the object, and/or significantly mar the object's appearance. For these and other reasons, those skilled in the art have attempted to find alternative ways to place objects inside of an inflated balloon.

One method which is currently in wide use involves placing the object inside a pressure chamber. The pressure chamber has a relatively large opening therein through which the object can readily pass. This opening is provided with an upstanding, circumferential lip, and the neck of the balloon is stretched around the lip so as to be in alignment with the opening.

With the object and the balloon thus in place, pressurized air is forced into the chamber containing the object and from the chamber, through the opening, and into the balloon. The balloon is thereby inflated. The object can then be inserted into the inflated balloon by pushing it through the opening, such as, for example, by means of rubber gloves which form a part of the walls of the pressure chamber. Thereafter, the inflated, object-filled balloon can be removed from the device and tied.

Notwithstanding the advantages this device and method affords over mechanically forcing an object into a balloon, significant disadvantages and difficulties remain. For example, it is often both difficult and time-consuming to stretch the neck of a balloon around the above-mentioned circumferential lip. It frequently requires several attempts before one is successful, and a number of balloons may be destroyed in the process.

The necessity of working within a confined pressure chamber can also cause problems. The space limitations of the chamber can sometimes make it awkward to insert the object into the inflated balloon. As a result, the object may not be positioned within the balloon in exactly the manner or orientation desired.

Further, the above-described pressure chamber is typically suited for use with only a fairly narrow range of balloon sizes. Since the neck of the balloon must be stretched around the circumferential lip adjacent the opening in the chamber, balloons having necks which are smaller than the opening cannot generally be used. Similarly, balloons having necks which are significantly larger than the opening in the pressure chamber may tend to work themselves loose either during inflation of the balloon or during insertion of the object. The opening in the pressure chamber also imposes a limit on the size of the object which can be inserted into a balloon, thereby making the use of larger balloon sizes somewhat undesirable.

BRIEF SUMMARY AND OBJECTS OF THE INVENTION

In view of the foregoing, it is a primary object of the present invention to provide an apparatus and method for placing an object inside an inflated balloon wherein the neck of the balloon can be readily enlarged to near its maximum size without destruction.

It is also an object of the present invention to provide an apparatus and method for placing an object inside an inflated balloon which is suited for use with a wide variety of balloon and object sizes.

In addition, it is an object of the present invention to provide an apparatus and method for placing an object inside an inflated balloon whereby the object can be inserted into the balloon without working inside a confined chamber.

Also, it is an object of the present invention to provide an apparatus and method for placing an object inside an inflated balloon wherein the object is easy to position and orient inside the balloon.

Additionally, it is an object of the present invention to provide an apparatus and method for placing an object inside an inflated balloon wherein neither the object nor its appearance are significantly, adversely affected.

It is a further object of the present invention to provide an apparatus and method wherein objects can be quickly and repetitively placed inside inflated balloons.

It is a still further object of the present invention to provide an apparatus and method for placing an object inside an inflated balloon in which the inflated, object-filled balloons can be easily removed from the apparatus without significant balloon deflation.

Consistent with the foregoing objects, and in accordance with the invention as embodied and broadly described herein, an apparatus is disclosed in one embodiment of the present invention as including a housing forming a first chamber, the housing having an orifice therein which communicates with the first chamber. Means is also provided for forming a substantially airtight seal between the orifice in the housing and the neck of a balloon when the balloon is positioned within said first chamber with the neck of the balloon extending through the orifice in the housing. In one presently preferred embodiment, this sealing means comprises a flexible diaphragm positioned in the orifice so as to surround the neck of the balloon. The apparatus further comprises means for evacuating the aforesaid first chamber of the housing, whereby a vacuum pressure is applied to the exterior of the balloon. The balloon is thereby inflated, and an object can be placed inside the inflated balloon through the orifice in the housing and the neck of the balloon.

It is also presently preferred to provide means for automatically enlarging the neck of the balloon to near its maximum size. In a preferred embodiment, such means comprises at least three rams positioned on the housing of the apparatus so as to substantially surround the aforesaid orifice, each ram having a retractable actuating rod which extends toward the orifice. A substantially L-shaped finger is attached to the actuating rod of each ram, each said finger extending through the orifice in the housing and into said first chamber. The fingers lie adjacent one another when the actuating rods of the rams are in an unretracted position such that the balloon can be positioned within the first chamber of the housing with the neck of the balloon lying around the L-shaped fingers and extending through the orifice. Suitable means is provided for retracting the actuating rods of the rams so as to enlarge the neck of the balloon.

The apparatus of the present invention optionally includes means for injecting compressed air into a balloon such that the balloon can be re-inflated, if necessary, after an object has been placed inside. According to one presently preferred embodiment, the housing forms both a first chamber and a second chamber. The means for evacuating the first chamber comprises a vacuum pump having an air intake port and an air exhaust port, the air intake port communicating with the first chamber of the housing and the air exhaust port communicating with the second chamber of the housing. Accordingly, upon actuation of the vacuum pump, the air pressure in the first chamber is decreased and the pressure in the second chamber is increased. The means for injecting compressed air into a balloon thus comprises a nipple means communicating with the second chamber of the housing. The nipple means is configured such that it can be connected to the neck of a balloon so as to inject pressurized air from said second chamber into the balloon.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENT

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 3, is not intended to limit the scope of the invention, as claimed, but it is merely representative of the presently preferred embodiment of the invention.

The presently preferred embodiment of the invention will be best understood by reference to the drawings, wherein like parts are designated by like numerals throughout.

Figure 1:
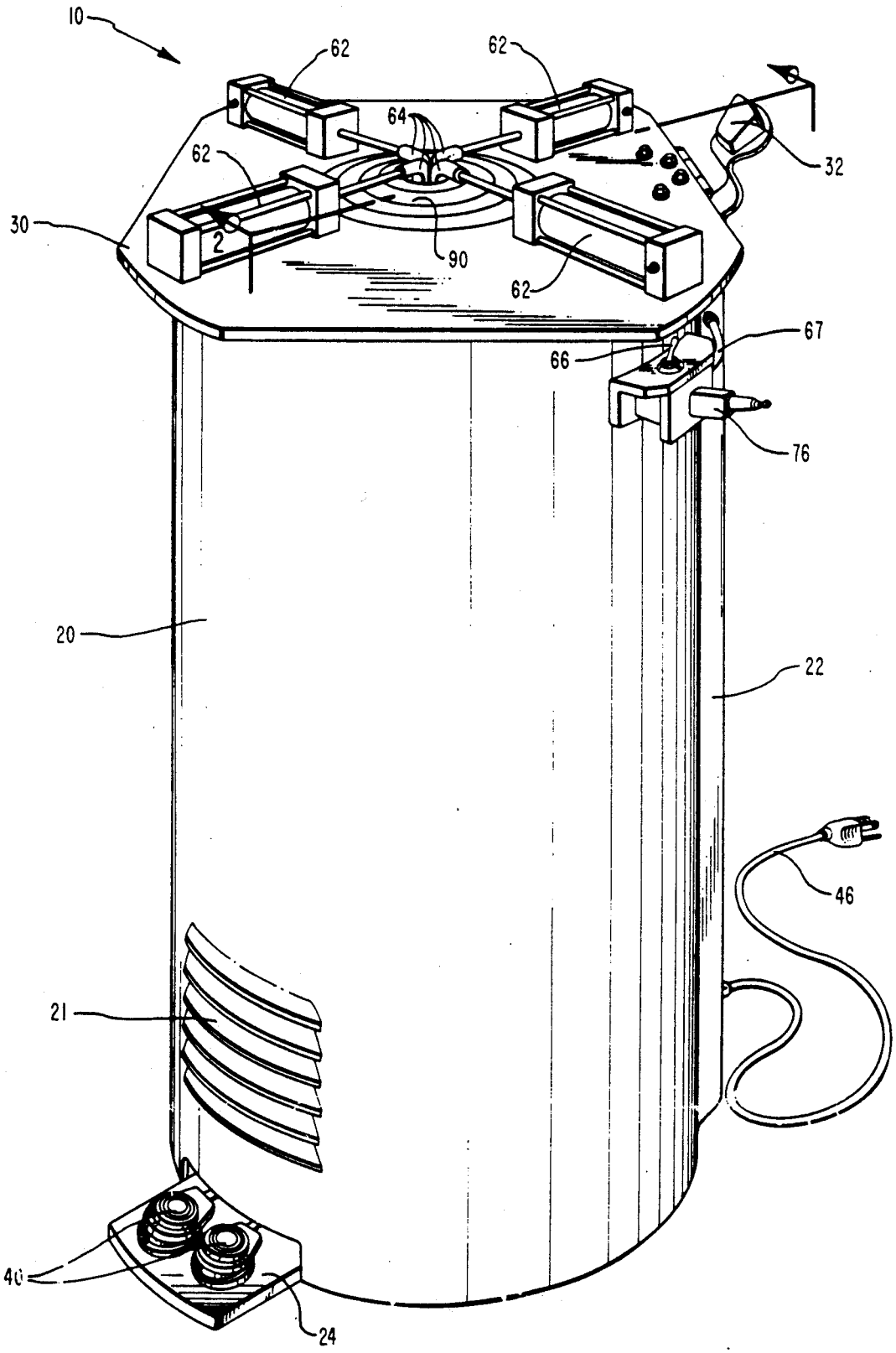
FIG. 1 is a perspective view illustrating one presently preferred embodiment of the apparatus of the present invention.

The apparatus of the present invention (generally designated at 10), is illustrated in its entirety in FIG. 1. While apparatus 10 may have any suitable shape, the presently preferred embodiment of apparatus 10 is shown herein as being substantially cylindrical in shape with a substantially cylindrical side wall 20.

Figure 2:
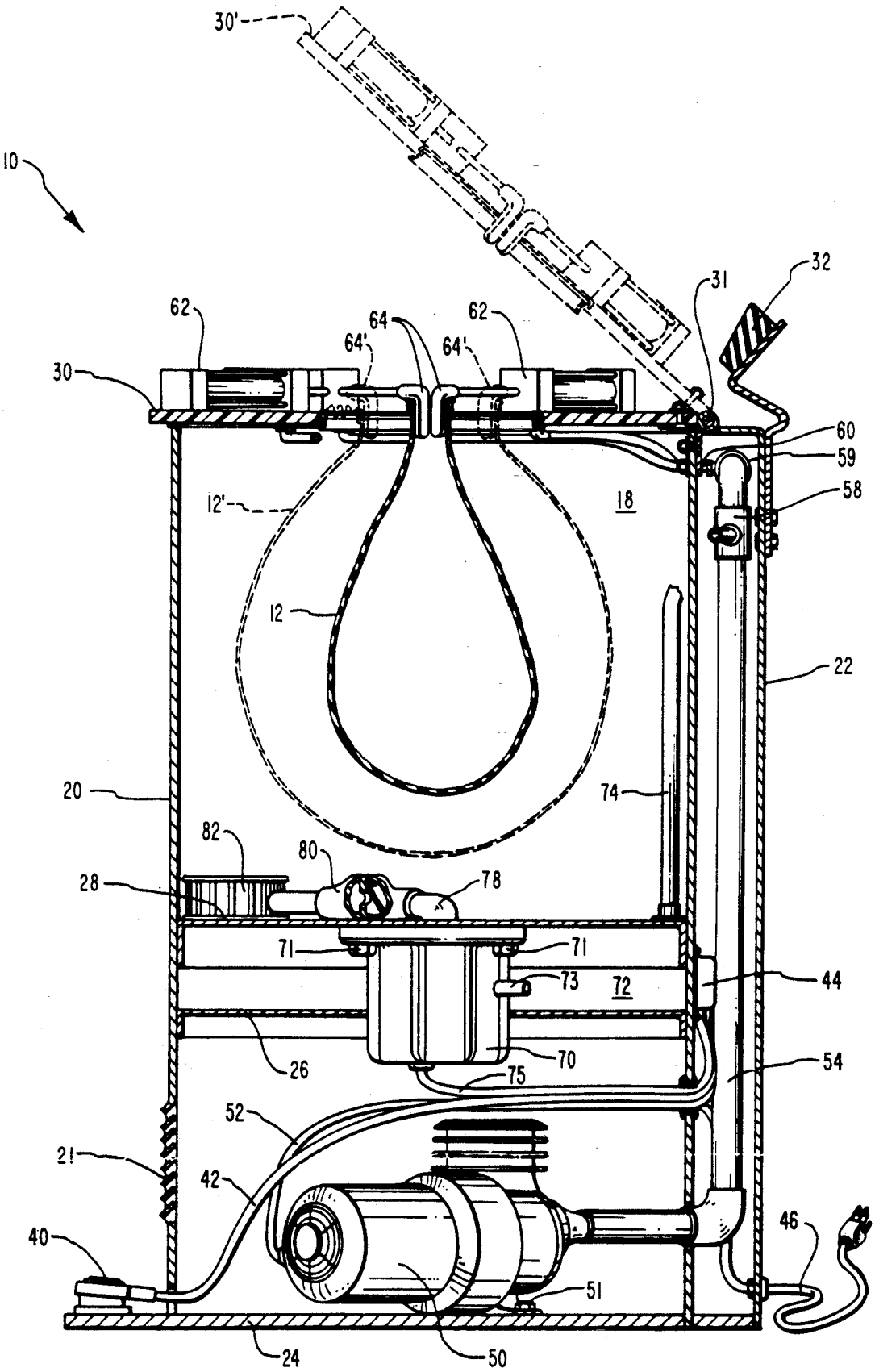
FIG. 2 is a vertical cross-sectional view taken along lines "2" of FIG. 1, broken lines being used to illustrate the manner in which the lid of the apparatus may be opened and also to illustrate the inflation of a balloon within the apparatus.
Figure 3:
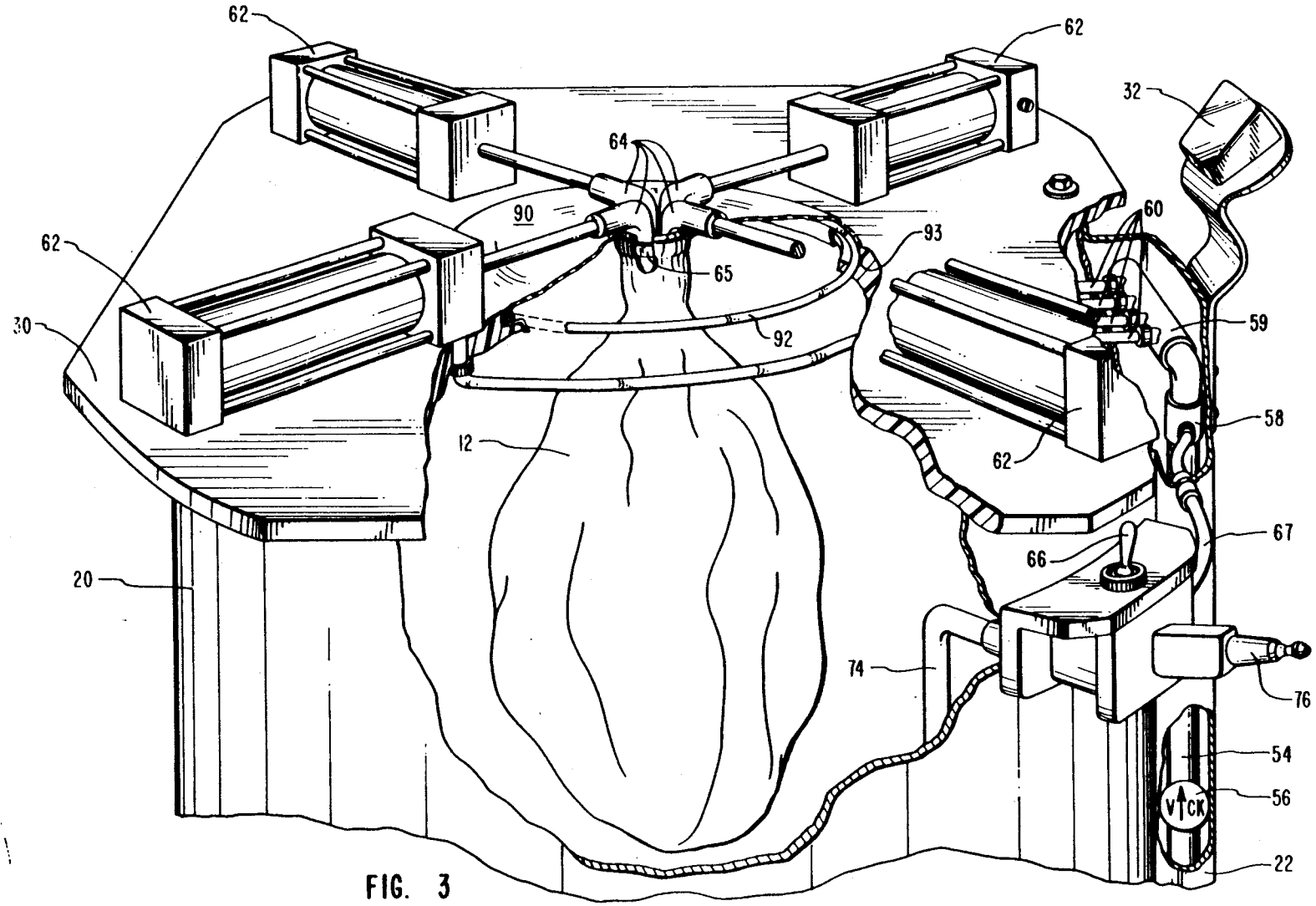
FIG. 3 is an enlarged perspective view of the lid of the apparatus, portions of the lid, balloon, and adjacent housing being broken away so as to more clearly reveal the internal construction.

As shown best in FIG. 2, apparatus 10 has a first chamber 18 which is defined by an upper portion of side wall 20, together with an intermediate partition 28 and a lid 30. Chamber 18 may be virtually any suitable size, but it is preferably large enough to easily accommodate the largest size of inflated balloon 12' one contemplates using with apparatus 10.

Significantly, apparatus 10 has an orifice which communicates with chamber 18. Preferably, such orifice is about 1 inch (2.54 cm) larger than the stretched neck of the largest balloon to be used with apparatus 10. While the orifice may be located at virtually any suitable position in apparatus 10 so as to be in open communication with chamber 18, the orifice 93 is advantageously formed in lid 30, as shown best in FIG. 3 herein.

In the preferred embodiment illustrated herein, lid 30 is a substantially flat member and may have any suitable thickness, such as, for example, between approximately $\frac{1}{8}$ inch (0.32 cm) and approximately $\frac{1}{2}$ inch (1.27 cm). Lid 30 is formed of a material which has sufficient structural strength to support rams 62, as will be described in further detail below. Lid 30 may, for example, be formed of aluminum, steel, wood or plastic.

Lid 30 is connected to side wall 20 by means of a hinge 31, thereby permitting lid 30 to be readily opened, as depicted in broken lines at 30' in FIG. 2. A stop member 32 is also preferably provided to support lid 30 in its open position. As shown, stop member 32 may be connected to a hinge support member 22 which extends upwardly along side wall 20 and also serves as a cover for some of the other components of apparatus 10 described below. Importantly, some means (not shown) is provided for forming a substantially air-tight seal between lid 30 and side wall 20. For example, a suitable rubber or plastic gasket may be provided between lid 30 and wall 20 in conventional fashion.

As a significant improvement over prior art devices, apparatus 10 includes means for automatically enlarging the neck of balloon 20. As will become more readily apparent from the discussion which follows, such means may be operated mechanically, electrically, hydraulically, or in a variety of other suitable fashions. It is presently preferred, however, that such means be pneumatic.

In the presently preferred embodiment illustrated herein, apparatus 10 has four pneumatic rams 62. It will be readily appreciated by those of ordinary skill in the art, however, that apparatus 10 would also work adequately with three rams or with any desired number of rams in excess of four. Rams 62 are preferably positioned on lid 30 so as to be substantially evenly distributed around orifice 93 (see FIG. 3), as shown. Rams 62 may be selected from a variety of commercially available rams, such as, for example, the rams currently manufactured by Bimba as Model No. 043-DP.

A substantially L-shaped finger 64 is provided on the end of the actuating rod of each ram 62. Of course, fingers 64 may alternatively have other suitable configurations which include a downwardly extending portion. As shown, fingers 64 extend downwardly through orifice 93 and into chamber 18 (see FIG. 2). Fingers 64 may be formed of any suitable material, such as, for example, a metal such as aluminum or steel.

As shown in FIG. 3, a resilient ring 65 is provided around the downwardly extending portions of fingers 64. Resilient ring 65 may, for example, be formed of a rubber material and is preferably of sufficient strength so as to continuously urge the actuating rods of rams 62 toward their fully extended positions. Ring 65 also assists in keeping balloon 12 inflated after an object has been placed inside, as will be described further below.

Referring now to FIG. 2, apparatus 10 includes a compressor 50 which may, for example, be secured to the bottom 24 of apparatus 10 by means of a bolt 51, as shown. Compressor 50 may be selected from a number of suitable, 21 commercially available compressors. For example, compressor 50 may be a Sears "Type 1" inflator which is currently available as model No. 900150250.

A tube 54 is operably connected to compressor 50 so as to convey compressed air away from compressor 50. As depicted schematically in FIG. 3, a one-way check valve 56 is provided along tube 54 so as to restrict the flow of air within tube 54 to substantially one-way flow in a direction away from compressor 50. Check valve 56 may, for example, be an Alkon model No. Cl check valve.

Compressed air passing through tube 54 and check valve 56 is directed toward rams 62 by means of tubes 60 and a suitable connector 59. Thus, compressed air from compressor 50 passes through tubes 54 and 60 and causes the actuating rods of rams 62 to retract. Significantly, check valve 56 substantially prevents air from travelling through tube 54 back toward compressor 50, thereby maintaining the actuating rods of rams 62 in their retracted position even after compressor 50 is no longer in operation.

In order to subsequently allow the actuating rods of rams 62 to extend, a purge valve 66 is connected to tube 54 by means of tube 67 and connector 58. When purge valve 66 is open, compressed air may escape from tubes 54 and 60, thereby permitting the actuating rods of rams 62 to be extended, such as, for example, by means of the continuous force exerted by resilient ring 65 (see FIG. 3). Purge valve 66 may be selected from a wide variety of commercially available valves. For example, purge valve 66 may be a Tneymadyne valve (model No. H0-30-1).

Apparatus 10 might also optionally be provided with other components associated with compressor 50 and rams 62 to assist in the proper retraction of the actuating rods of rams 62. For example, a suitable pressure control device might be provided in tube 54 to control the pressure provided to rams 62. In addition, a gauging ring (such as, for example, of rope or nylon), might be positioned around fingers 64 to limit the retraction of the actuating rods of rams 62 and thereby prevent the overextension of the neck of balloon 12. Alternatively, mechanical stops associated with rams 62 could be used for the same purpose.

With particular reference to FIG. 3, apparatus 10 further comprises means for forming a substantially air-tight seal between orifice 93 and the neck of a balloon 12. As shown, such sealing means may, for example, be in the form of a thin, flexible diaphragm 90 having a central hole therethrough. Diaphragm 90 may be formed of any suitable material, such as, for example, a thin rubber material.

Diaphragm 90 is positioned within orifice 93 such that, when the actuating rods of rams 62 are fully extended, the downwardly extending portions of fingers 64 extend through the central hole in diaphragm 90 and into chamber 18 (see FIG. 2). For example, orifice 93 may be substantially circular in shape, and the circumference of orifice 93 may be configured as a recessed ledge, as shown. In such case, diaphragm 90 may be stretched over a rigid ring 92 which is adapted to fit snugly within orifice 93, whereby diaphragm 90 is retained by friction within orifice 93 between the circumference of orifice 93 and ring 92. Ring 92 may, for example, be formed of a metal rod having a diameter of approximately ⅛ inch (0.32 cm).

Referring again to FIG. 2, apparatus 10 has means for evacuating chamber 18. For this purpose, it is presently preferred to provide a vacuum pump 70. Vacuum pump 70 may be connected to partition 28 by means of bolts 71 in conventional fashion, and may be selected from a variety of commercially available models. For example, vacuum pump 70 may be an Ametec rotary vacuum pump currently available as model No. 116325-00.

In order to maintain vacuum pressure inside chamber 18 without the need to operate vacuum pump 70 continuously, a one-way plumber's check valve 80 is connected to the air intake port of vacuum pump 70 by means of a suitable connector 78. A filter 82 is also advantageously connected to vacuum pump 70 in order to prevent damage to vacuum pump 70 as a result of taking in any extraneous debris.

In many instances, it may be desirable to inject additional air into a balloon 12 after a desired object has been inserted but before the balloon is tied. Therefore, apparatus 10 preferably includes a suitable mechanism for filling a balloon with air. For example, by providing appropriate connectors to compressor 50, it will be readily appreciated that compressor 50 may be used to provide a source of air for inflating a balloon. Alternatively, in the presently preferred embodiment, a source of air for inflating a balloon may be obtained from the air exhaust port of vacuum pump 70.

As illustrated in FIG. 2, a second partition 26 may be used in cooperation with side wall 20 so as to form a second chamber 72. Chamber 72 is in communication with the exhaust port 73 of vacuum pump 70, whereby operation of vacuum pump 70 causes air to be compressed within chamber 72. A suitable tube 74 is connected to chamber 72 so as to convey compressed air out of chamber 72. As depicted in FIG. 3, tube 74 is operably connected to a filling nipple 76 which is adapted to be connected to the neck of a balloon. It will be appreciated that a balloon can thus be inflated with air through nipple 76 by operation of vacuum pump 70.

With continuing reference to FIG. 2, compressor 50 and vacuum pump 70 may be located in a compartment of apparatus 10 below chambers 18 and 72. In such case, a vent 21 may be formed in side wall 20 to insure proper air circulation. Conventional pedal switches 40 may be provided for actuating compressor 50 and vacuum pump 70, and electrical power may be provided to apparatus 10 in any suitable fashion. For example, power cord 46 may be connected to a circuit box 44, and pedal switches 40, compressor 50, and vacuum pump 70 may each then be operably connected to circuit box 44 by means of respective wires 42, 52, and 75.

In use, lid 30 of apparatus 10 is opened as illustrated at 30' in FIG. 2. With lid 30 open, the neck of a balloon is placed around the downwardly extending portions of fingers 64 so as to surround the resilient ring 65 (see FIG. 3). Lid 30 is then closed.

Purge valve 66 is initially closed. Therefore, by pressing on the appropriate pedal switch 40, compressor 50 may be actuated so as to retract fingers 64, as depicted at 64' in FIG. 2. The neck of balloon 12 is thereby enlarged as shown at 12'. Significantly, since check valve 56 (see FIG. 3) prevents air from escaping from rams 62 through tube 54, the neck of balloon 12 is retained in its enlarged state even after the operation of compressor 50 ceases.

Vacuum pump 70 is thereafter actuated by pressing the appropriate pedal switch 40. As noted above, diaphragm 90 surrounds the enlarged neck of balloon 12 so as to form a substantially air-tight seal between the neck of balloon 12 and orifice 93. As a result, chamber 18 is evacuated by the operation of vacuum pump 70, and balloon 12 is inflated. The desired object may then be inserted into balloon 12 through its enlarged neck.

With the desired object properly positioned inside balloon 12, purge valve 66 (see FIG. 3) is opened, thereby allowing the actuating rods of rams 62 to retract. Such retraction is assisted by the continuous force exerted on fingers 64 by the neck of balloon 12 and resilient ring 65.

When fingers 64 are fully extended, diaphragm 90 may no longer form an air-tight seal between the neck of balloon 12 and orifice 93 due to the central hole in diaphragm 90. Consequently, chamber 18 will not retain its vacuum pressure, and air may begin to escape from balloon 12. Advantageously, resilient ring 65 helps reduce the loss of air from balloon 12 by forming an air-tight seal with the neck of balloon 12 and thereby forcing substantially all of the escaping air to pass through the relatively narrow passageway formed between fingers 64 in their fully extended position. Of course, other methods might also be employed for preventing deflation of balloon 12, such as, for example, the placement of a resilient cord or other sealing member in the passageway between fingers 64 in their fully extended position. However, it has been found that the use of resilient ring 65 typically prevents significant deflation before balloon 12 can be removed from apparatus 10.

In order to remove balloon 12 from apparatus 10, lid 30 is again opened. After removal from fingers 64, balloon 12 may then be partially re-inflated, if necessary, by actuating vacuum pump 70 and connecting the neck of balloon 12 to filling nipple 76. Finally, the inflated, object-filled balloon can be tied in conventional fashion.

From the above discussion, it will be appreciated that the present invention provides for significant advantages over the prior art. For example, the present invention provides an apparatus and method for placing an object inside an inflated balloon wherein the neck of the balloon can be readily enlarged to near its maximum size without destruction. In addition, since the amount by which the neck of the balloon is enlarged can be varied substantially continuously in using the apparatus of the present invention, it is clear that this invention also provides an apparatus and method for placing an object inside an inflated balloon which is suited for use with a wide variety of balloon and object sizes.

Further, in using the apparatus and method of the present invention, an object can be inserted inside an inflated balloon without working inside a confined chamber. As a result, this invention provides an apparatus and method for placing an object inside an inflated balloon wherein the object is easy to position and orient inside the balloon. Moreover, due to the ease of inserting the object into the balloon using the present invention, neither the object nor its appearance are significantly, adversely affected.

Also, unlike many prior art devices, the apparatus of the present invention is readily adapted to repetitive use, and objects can thus be quickly and repetitively placed inside inflated balloons. The present invention further provides for the ready removal of the object-filled balloon without significant balloon deflation.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for use in placing an object inside an inflated balloon, the apparatus comprising:

a housing forming a first chamber, the housing having an orifice therein which communicates with the first chamber;

means for forming a substantially air-tight seal between the orifice in the housing and the neck of a balloon when the balloon is positioned within said first chamber with the neck of the balloon extending through the orifice in the housing, said means for forming a substantially air-tight seal comprising a flexible diaphragm positioned in said orifice in the housing so as to substantially occlude the orifice, the diaphragm having a hole therethrough which communicates with said first chamber; and means for evacuating said first chamber, whereby the balloon is inflated and the object can be placed inside the inflated balloon through the orifice in the housing and the neck of the balloon.

2. An apparatus for use in placing an object inside an inflated balloon as defined in claim 1 wherein the orifice in the housing is substantially circular in shape, wherein the flexible diaphragm is stretched over a substantially circular, rigid ring, and wherein the ring is secured within said orifice.

3. An apparatus for use in placing an object inside an inflated balloon, the apparatus comprising:

a housing forming a first chamber, the housing having an orifice therein which communicates with the first chamber;

means for enlarging the neck of a balloon when the balloon is positioned within said first chamber with the neck of the balloon extending through the orifice in the housing, said means for enlarging the neck of a balloon comprising:

(a) at least three rams positioned on the housing so as to substantially surround said orifice, each ram having a retractable actuating rod which extends toward the orifice;

(b) a substantially L-shaped finger attached to the actuating rod of each ram, each said finger extending through the orifice in the housing and into said first chamber, said fingers lying adjacent one another when the actuating rods of the rams are in an unretracted position such that a balloon can be positioned within the first chamber of the housing with the neck of said balloon lying around said fingers and extending through the orifice; and (c) means for retracting the actuating rods of the rams so as to enlarge the neck of a balloon lying around said fingers;

means for forming a substantially air-tight seal between the orifice in the housing and the enlarged neck of the balloon, said means for forming a substantially air-tight seal comprising a flexible diaphragm positioned in said orifice in the housing so as to substantially occlude the orifice, the diaphragm having a hole therethrough which communicates with said first chamber; and means for evacuating said first chamber, whereby the balloon is inflated and the object can be placed inside the inflated balloon through the orifice in the housing and the enlarged neck of the balloon.

4. An apparatus for use in placing an object inside an inflated balloon as defined in claim 3 further comprising a resilient ring positioned around said L-shaped fingers so as to continuously urge the retractable actuating rods of the rams toward an unretracted position.

5. An apparatus for use in placing an object inside an inflated balloon, the apparatus comprising:

a housing forming a first chamber and a second chamber, the housing having a lid which may be opened so as to afford access to the first chamber, and said lid having an orifice therein which communicates with the first chamber when the lid is closed;

a flexible diaphragm positioned in said orifice in the lid of the housing so as to substantially occlude the orifice, the diaphragm having a hole therethrough which communicates with said first chamber when the lid of the housing is closed;

at least three rams positioned on the lid of the housing so as to substantially surround said diaphragm, each ram having a retractable actuating rod which extends toward the diaphragm;

a substantially L-shaped finger attached to the actuating rod of each ram, each said finger extending through the hole through said diaphragm and into said first chamber of the housing, said fingers lying adjacent one another when the actuating rods of the rams are in an unretracted position such that a balloon can be positioned within the first chamber of the housing with the neck of said balloon lying around said fingers and extending through the hole through the diaphragm;

means for retracting the actuating rods of the rams so as to enlarge the neck of a balloon lying around said fingers and form a substantially air-tight seal between said neck of the balloon and the flexible diaphragm;

a vacuum pump having an air intake port and an air exhaust port, the air intake port communicating with the first chamber of the housing and the air exhaust port communicating with the second chamber of the housing, whereby the pressure in the first chamber is decreased and the pressure in the second chamber is increased when the vacuum pump is actuated; and a nipple means communicating with said second chamber of the housing, the nipple means being configured such that it can be connected to the neck of a balloon so as to inject air from said second chamber into the balloon.

6. An apparatus for use in placing an object inside an inflated balloon as defined in claim 5 wherein the orifice in the lid of the housing is substantially circular in shape, wherein the flexible diaphragm is stretched over a substantially circular, rigid ring, and wherein the ring is secured within said orifice.

7. An apparatus for use in placing an object inside an inflated balloon as defined in claim 5 further comprising a resilient ring positioned around said L-shaped fingers so as to continuously urge the retractable actuating rods of the rams toward an unretracted position.

8. An apparatus for use in placing an object inside an inflated balloon as defined in claim 5 wherein the rams are pneumatic rams and wherein the means for retracting the actuating rods of the rams comprises:

a source of compressed air;

a conduit connecting the source of compressed air to the rams;

a one-way check valve positioned in said conduit between the rams and the source of compressed air so as only to allow substantial air flow in a direction away from the source of compressed air and toward the rams; and a selectively openable purge valve connected to the conduit between the rams and the one-way check valve.

9. An apparatus for use in placing an object inside an inflated balloon as defined in claim 14 further comprising:

a one-way check valve connected to the air intake port of the vacuum pump so as only to allow substantial air flow in a direction into the air intake port; and an air filter means connected to said check valve so as to filter air before it passes through the check valve and into the air intake port.

* * * * *